United States Patent [19]

Carr

[11] Patent Number: 4,492,851

[45] Date of Patent: Jan. 8, 1985

[54] SWAP ACTION ARRANGEMENT MOUNTING AN ELECTRIC DEFROSTER HEATER TO A FINNED REFRIGERATION UNIT

[75] Inventor: Charles R. Carr, Manitou Beach, Mich.

[73] Assignee: Brazeway, Inc., Adrian, Mich.

[21] Appl. No.: 411,219

[22] Filed: Aug. 25, 1982

Related U.S. Application Data

[63] Continuation-in-part of Ser. No. 221,126, Dec. 29, 1980, abandoned.

[51] Int. Cl.[3] ..... H05B 3/40; F25D 21/08; F28F 1/30

[52] U.S. Cl. ..... 219/201; 29/157.3 A; 62/276; 165/181; 219/365; 219/530; 219/536; 219/540; 219/542

[58] Field of Search ..... 219/200, 201, 365, 526, 219/536, 542, 540, 530; 62/275, 276; 165/181, 182; 29/157.3 R, 157.3 A, 157.3 B

[56] References Cited

U.S. PATENT DOCUMENTS

| | | | |
|---|---|---|---|
| 2,170,774 | 8/1939 | Fagan | 165/181 X |
| 2,266,373 | 12/1941 | Marlo | 219/201 X |
| 2,529,215 | 11/1950 | Hicke | 219/201 X |
| 2,558,952 | 7/1951 | Hayward | 219/201 X |
| 3,063,253 | 11/1962 | Dickson et al. | 219/201 X |
| 3,099,914 | 8/1963 | De Witt et al. | 219/201 X |
| 3,153,443 | 10/1964 | Kritzer | 165/181 X |
| 3,780,797 | 12/1973 | Gebelius | 165/181 X |

FOREIGN PATENT DOCUMENTS

| | | | |
|---|---|---|---|
| 167999 | 8/1956 | Australia | 62/276 |
| 855394 | 11/1960 | United Kingdom | 219/201 |

*Primary Examiner*—A. Bartis

*Attorney, Agent, or Firm*—Krass & Young

[57] ABSTRACT

An evaporative cooling unit for a refrigeration system includes a plurality of spaced, parallel metal heat exchanging fins provided with a plurality of openings receiving successive turns of a coiled tube adapted to carry refrigerant through the unit. The fins are further provided with snap-action cutouts extending from the periphery of the fins inwardly to a location between adjacent rows of the coil turns and a rod-like electric resistance heating element for periodicaly defrosting the unit is held in the cutouts. Each cutout includes an entry slot inwardly tapered to a throat defined by deformable edges spaced apart a distance marginally less than the diameter of the heating element to present resistance to the passage of the heating element through the throat and a notch communicating with the throat and within which the heating element is held. The notch has a first dimension parallel to the entry slot which is greater than the diameter of the heating element and a second dimension transverse to the entry slot substantially equal to the heating element diameter to allow the heating element to clear the throat upon insertion into the notch but to be firmly held in the notch.

2 Claims, 10 Drawing Figures

SWAP ACTION ARRANGEMENT MOUNTING AN ELECTRIC DEFROSTER HEATER TO A FINNED REFRIGERATION UNIT

REFERENCE TO RELATED APPLICATIONS

This application is a continuation-in-part of co-pending application Ser. No. 221,126, filed Dec. 29, 1980, now abandoned.

TECHNICAL FIELD

This invention generally relates to evaporative cooling units, and deals more particularly with heat exchanging fin designs for such units.

BACKGROUND ART

Refrigerators, such as those employed to store food or the like in households, typically employ an evaporator unit in which refrigerant fluid at low pressure is evaporated to cool a refrigerating compartment. The fluid is then compressed and delivered to a condenser where heat is extracted from the fluid. These evaporator units typically employ a refrigerant delivery tube arranged in a plurality of coil turns arranged in two or more adjacent rows. A plurality of spaced apart, heat exchanging fins are connected to the coil turns and extend transversely between adjacent rows of the coil in order to conduct heat from the refrigerating compartment to the coil, and thus to the refrigerant fluid.

Condensation normally forms on both the coil and the fins of these evaporator units that results in an accumulation of frost and ice which eventually impair the operating efficiency of the unit. Consequently, it is necessary to periodically remove the frost and ice by turning off the unit and/or applying localized heat to the areas of frost and ice. So called "frost free" refrigerators eliminate the need for shutting down the unit in order to defrost the evaporator unit by mounting a heating element adjacent the rows of coil turns. The heating element comprises a resistance wire disposed within elongate rod having a sheathing material such as Inconel for withstanding relatively high temperatures. The rod is mounted by means of chips and/or fittings on the coil or fins so as to be free-floating between coil turns, adjacent the bottom of the unit. The heating element is periodically energized in order to convert the frost and ice to liquid which then falls into a drip pan positioned beneath the unit. The heating element also functions to melt ice forming within the drip pan itself.

Evaporator units of the type described above were less than completely satisfactory in several respects. The method of mounting the heating element on the unit was relatively costly due to the special mounting hardware, as well as the labor necessary to assemble the hardware. Heat transfer from the heating element to the coils and fins was somewhat inefficient since the mounting hardware insulated the heating element from direct contact with the coils and fins; consequently, a certain amount of heat energy was transferred from the heating element to the surrounding environment which could otherwise be directly transferred to the coils and fins by conduction if the heating element was mounted in direct engagement with the coils and/or fins. Because of the inefficiency mentioned above, incomplete defrosting of the coils and fins was less than optimum, particularly near the bottom of the unit.

Finally, the sheathing materials employed in the heating rod were either relatively thick or were comprised of special alloys selected to withstand relatively high surface temperatures because of the fact that the rod was effectively insulated from the remainder of the unit by the mounting hardware. Thinner or less costly sheathing materials could be employed if a mounting arrangement were provided which reduced the surface temperature of the heating rod.

SUMMARY OF THE INVENTION

Each of the disadvantages mentioned above is overcome by the cooling unit of the present invention. According to the invention, an evaporative cooling unit for a refrigeration system includes a plurality of spaced, heat exchanging fins provided with specially configured cutouts therein for retaining an elongate heating element employed for periodically defrosting the unit. Each of the fins is further provided with a plurality of openings for receiving successive turns of a coil tube adapted to carry refrigerant fluid through the unit. The cutouts extend from the periphery of the fins inwardly to a location between adjacent rows and coil turns and comprises a notched portion configured to receive the heating element and a tapered, slot portion for guiding the heating element into the notched portion during assembly of the unit. The heating element comprises a rod which directly engages the fins at contact locations defined by the cutouts, thereby providing a direct path for conductively transferring heat energy from the heat element to the fins. This conductive heat transfer considerably increases the efficiency of the unit and reduces the surface temperature of the heating element, thereby permitting the use of a relatively thin or different, less costly sheath over the heating element. In an alternate form of the invention, two or more notched portions are provided in each fin to provide a plurality of mounting locations for the heating element. In still another form of the invention, a locking tab is provided on each fin within the corresponding cutout to assure that the heating element is not dislodged by vibrations or the like. A throat connects the notch with the slot and is elastically deformed when the heating element is inserted through the slot into the notch. The notch is preferably elongate to permit the heating element to clear the throat during installation, thereby allowing the throat to snap back to its normal position locking the heat element within the notch.

BRIEF DESCRIPTION OF THE DRAWINGS

In the drawings, which form an integral part of the specification and are to be read in conjunction therewith, and in which like components are designated by identical reference numberals in the various views.

BEST MODE FOR CARRYING OUT THE INVENTION

Figure 1:
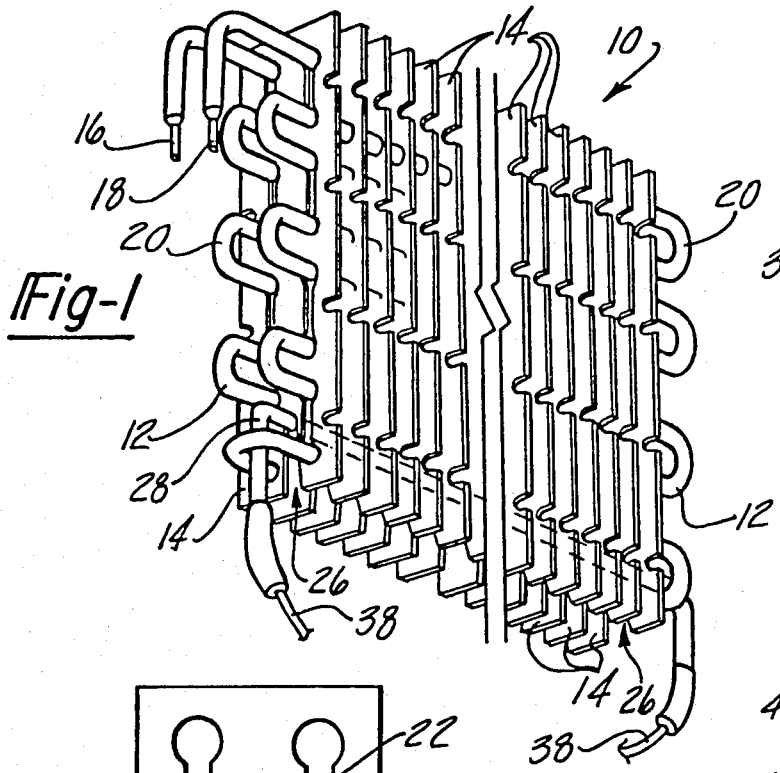
FIG. 1 is a bottom perspective view of an evaporative cooling unit having heat exchanging fins provided with improved heater element cutouts which form the preferred embodiment of the present invention.
Figure 2:
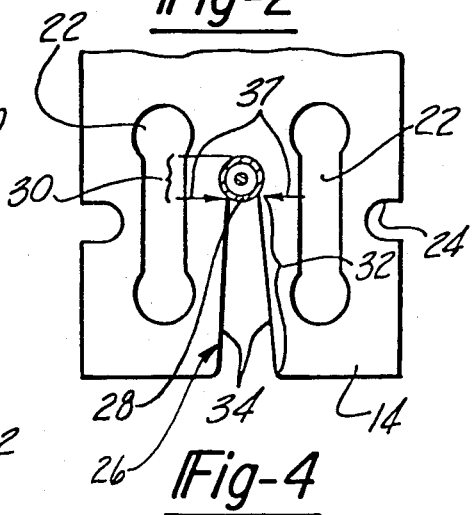
FIG. 2 is a fragmentary, elevational view of the lower end of one of the fins of the unit shown in FIG. 1, shown in operative relationship to the heating element.
Figure 3:
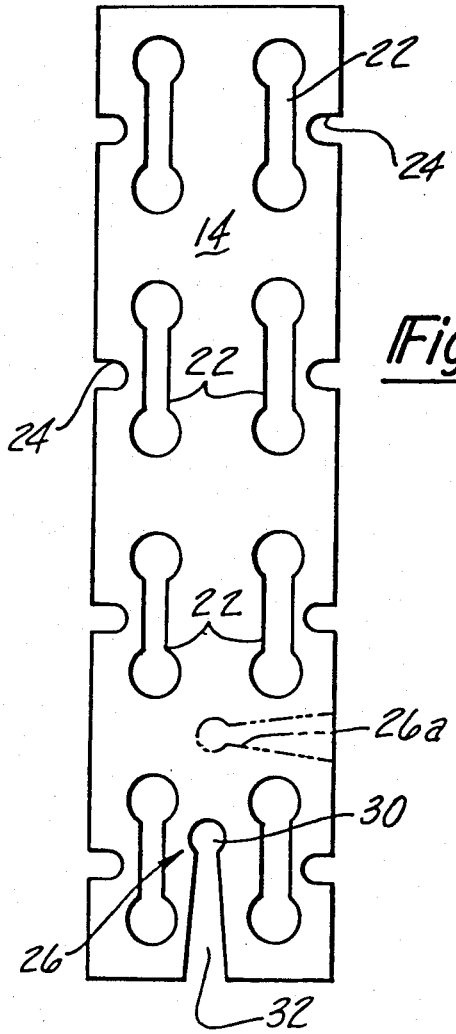
FIG. 3 is an elevational view of one of the fins of the unit of FIG. 1, having been removed from the unit.

Referring to FIGS. 1–3 of the drawings, the present invention is broadly concerned with an evaporative cooling unit generally indicated by the numeral 10 adapted for use in a conventional refrigerator (not shown). The evaporator unit 10 comprises a cooling coil 12 mounted in heat transferring relationship to a plurality of parallel, spaced apart cooling fins 14.

Coil 12 comprises a single tube having an inlet 16 and outlet 18 adapted to be coupled with the refrigerant fluid lines of the refrigerator. Coil 12 comprises a plurality of coil turns 20 arranged in two essentially parallel spaced apart rows thereof. The fins 14 are planar and comprise heat conductive material, such as aluminum. Fins 14 extend transversely between the opposing rows of coil turns 20 and are provided with rows and columns of elongate apertures 22 for respectively receiving the coil turns 20 therethrough. A plurality of notches 24 may be provided in the periphery of the fins 14 which act to locate the fins 14 in tooling fixtures during manufacturing processes and may later by employed for matingly receiving serpentine-shaped rods (not shown) forming another part of the refrigeration system.

At least certain of the fins 14 are provided with a cutout, generally indicated by the numeral 26, therein along the periphery thereof for receiving and holding a heating element 28 near the bottom of the unit 10, between the opposing rows of coil turns 20. As best seen in FIGS. 2 and 3, the cutout 26 is disposed along the lower edge of fin 14, and extends upwardly to a location between a pair of apertures 22. The cutout 26 includes a notch portion 30 at the apex thereof, which is preferably configured to matingly receive the heating element 28 therein. In connection with the preferred form of the invention, heating element 28 which will be discussed later in more detail, comprises an elongate rod having a circular cross section, consequently, the notch portion 30 is also substantially circular in shape. The notch portion 30 is configured such that it substantially encircles a portion of heating element 30.

Cutout 26 further includes a slot portion 32 defined by a pair of opposing edges 34 which taper inwardly toward notch portion 30. Slot portion 32 communicates with notch portion 30 and the distance indicated by the arrows 37 between the edges 34 defining the transition opening between the notch portion 30 and the slot portion 32 is less in magnitude than the minimum cross sectional dimension of the heating element 28. Thus, in the case of a heating element 28 having a circular cross section, distance 36 is less than the diameter of the heating element 28. Preferably, the distance 37 is only marginally less than the minimum cross sectional dimension of the heating element 28, such that upon insertion of heating element 28 through slot portion 32 into notch portion 30, the sides of the heating element 28 tightly frictionally engage the transitional area and snap into the notch portion 30; thereafter, the transition opening between notch portion 30 and slot portion 32 prevents removal of the heating element 28 unless a substantial downward pressure is applied thereto. The material of which fins 14 are comprised may be relatively flexible so as to deform upon passage of the heating element 28 through the transition area into notch portion 30, thus adding to the snap action interfit of the heating element 28 and the fin cutout 26.

Although cutout 26 is shown as extending substantially parallel to the plane in which the rows of coil turns 20 are disposed, such cutouts may also be formed along a vertical extending edge of the fins 14, as indicated in phantom at **26*a***.

As previously mentioned, only certain ones of the fins 14 need be provided with the cutout 26 therein in order to support the heating element 28 at spaced locations; in the event that only certain of the fins 14 are provied with the cutouts 26 therein, appropriate oversized slots or apertures are provided in the remaining fins 14, in axial alignment with the cutouts 26 so as to accommodate the full length of heating element 28.

Heating element 28 comprises a standard resistance wire housed within a sheathing rod and provided with a pair of electrical leads 38 adapted to be connected with an electrical control system for selectively energizing the heating element 28. The material of which the sheathing of rod 28 is comprised need not be tolerant of high temperatures, and the wall thickness thereof may be relatively small, for reasons which will be discussed below.

Figure 4:
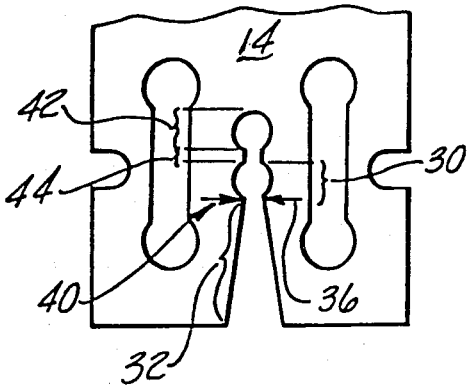
FIG. 4 is a fragmentary, elevational view of the lower end of a heat exchanging fin having an alternate form of heater element cutout therein.

Attention is now directed to FIG. 4 wherein an alternate form of fin cutout, generally indicated at 40, is depicted. Cutout 40 includes a slot portion 32 and notch portion 30 which communicate with each other through transition opening 36, essentially identical to the cutout 26 previously described. Additionally, however, cutout 40 includes a second notch portion 42 which is essentially identical to notch portion 30 but is vertically spaced thereabove and connected therewith through a passageway 44. Passageway 44 possesses a width marginally less in magnitude than the minimum cross sectional dimension of the heating element 28, and therefore is essentially identical in width dimension to the opening 36. Notch portions 30 and 42 defined alternate locations at which the heating element 28 may be positioned, so as to provide more than one choice of elevational location for the heating element 28.

Figure 5:
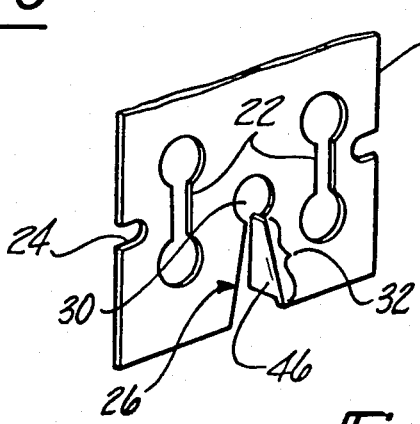
FIG. 5 is a fragmentary, perspective view of a fin having another alternate form of heating element cutout therein, with the locking tab thereof being shown in the open position.
Figure 6:
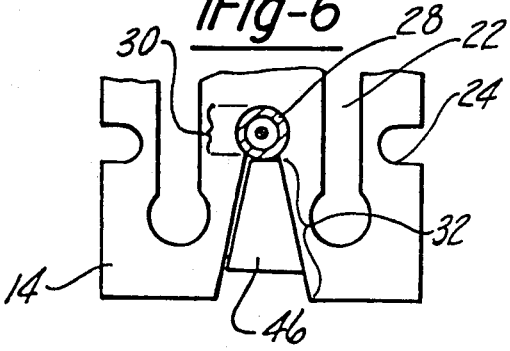
FIG. 6 is a fragmentary, elevational view of the fin shown in FIG. 5, with a heating element having been mounted within the fin and the locking tab having been shifted to a closed, locking position.
Figure 7:
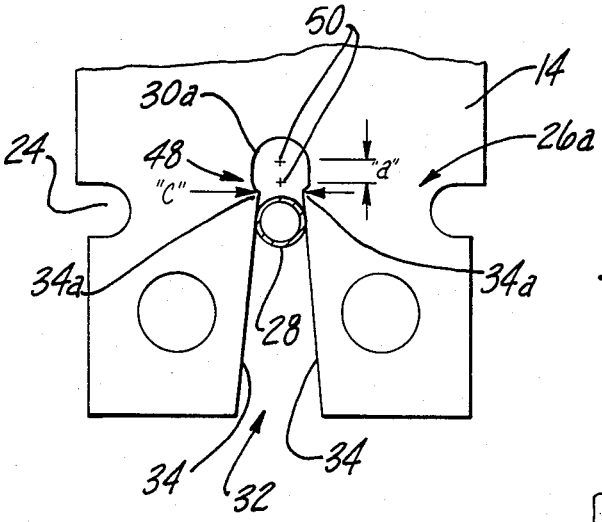
FIGS. 7–10 are fragmentary, elevational views of another aternate form of the heater element cutout, depicting successive stages in the installation of the heating element.
Figure 8:
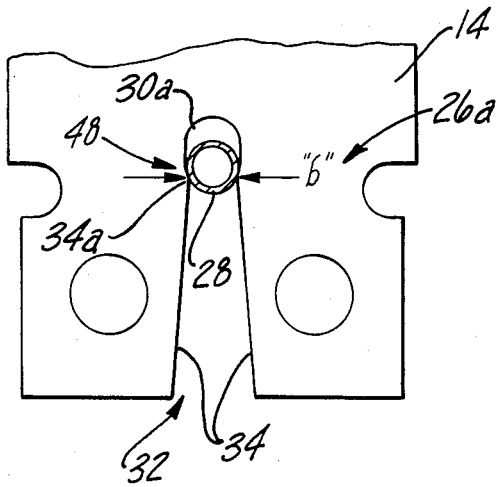

In some cases, it may be desirable to provide a safety interlock on at least certain of the fins 14 to assure that pressures imposed on the heating element 28 by sharp impact imparted to the refrigerator during shipping or the like do not snap the heating element 28 out of the notch portion 30. Accordingly, as shown in FIGS. 5 and 6, a locking tab 46 may be provided to block the return of the heating element 28 through slot portion 32. Locking tab 46 is most desirably formed integral with fin 14 and is pivotally connected along one of the edges 34 so as to be pivoted from an open position, as shown in FIG. 5, to a closed, locking position as shown in FIG. 6. Preferably, the upper edge of locking tab 46 engages the heating element 28 when the tab 46 is pivoted to its closed position.

Attention is now directed to FIGS. 7–10 wherein another alternate form of the heater cutout **26*a* is depicted. Heater cutout 26*a* includes a slot 32 defined by opposing edges 34 which taper inwardly from the periphery of the fin 14 to a throat 48. The throat 48 is defined by opposing edges 34***a*, the distance between edges 34*a* being designated by the letter "c" in FIG. 9 when such edges are in their normal, nondeformed state. Distance "c" is marginally less in magnitude than the outside diameter of heating element 28. Edges 34*a* are preferably formed of resilient, deformable metal so as to substantially return or "snap back" to their normal, nondeformed position after the heating element 28 is passed through throat 48.

The notch 30*a* contiguous with throat 48 is elongate in a direction which is substantially aligned with the longitudinal axis of slot 32. The top and bottom of notch 30*a* are each substantially semicircular and have radii essentially identical to that of heating element 28, the distance between the centers 50 of such radii being indicated by the letter "a" in FIG. 7. Distance "a" is sufficient to create a clearance between the heating element 28 and throat 48 for reasons which will become later apparent. It is important to note that a substantial portion of the periphery of heating element 28 conformingly engages the fin 14 at the bottom of notch 30*a* thereby imparting maximum heat transfer from element 28 to fin 14.

INDUSTRIAL APPLICABILITY

The heat exchanging fins having the improved heater element cutouts therein described above have application in various types of heating and cooling units, but are particularly useful in evaporative cooling units as previously described, which include a heating element employed to periodically remove frost or ice from the unit.

Apertures 22 as well as cutouts 26 and 40 may be formed by die cutting if desired. After coil turns 20 have been arranged in two opposing rows, the fins 14 are slid onto coil turns 20; the opposing edges defining the apertures 22 are dimensioned so as to frictionally engage the coil turns 20, thereby securely holding the fins 14 on the coil. The heating element 28 is then passed into a longitudinal opening defined by the slot portions 32 of the cutouts 26. The opposing edges 34 guide the body of the heating element 28 toward the opening 37. Additional pressure is then imparted to heating element 28 so as to force the latter past the opening 37 and into the notch portion 30, thereby securely mounting the heating element 28 on unit 10.

In the case of the embodiment shown in FIG. 4, if it is desired to mount the heating element 28 at a higher location, additional pressure is then added to force the heating element 28 through the passageway 44 and into notch portion 42; that portion of fin 14 defining opening 36 and passageway 44 snaps back to its original shape, due to its resilience after the passageway therethrough of the heating element 28.

In the event that the embodiment shown in FIGS. 5 and 6 is employed, the locking tab 46 is pivoted about the edge 34 to which it is attached into a closed, locking position, shown in FIG. 6, in order to assure that the heating element 28 is not jarred free of its mounted position.

Figure 9:
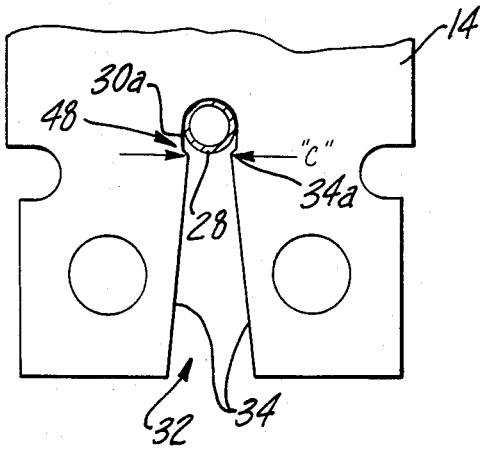
Figure 10:
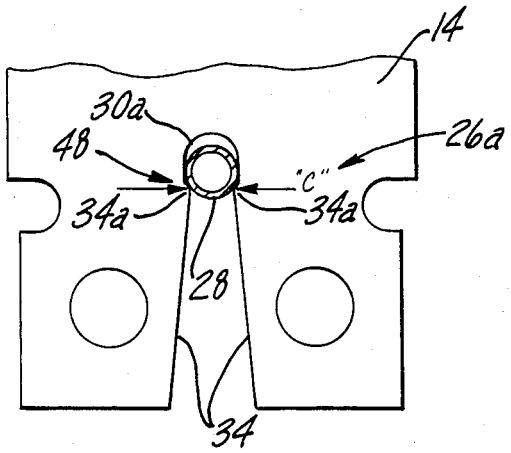

With respect to the cutout 26*a* shown in FIGS. 7–10, the heating element 28 is inserted through the slot 32 and is forced through throat 48 causing edges 34*a* to be deformed outwardly until a clearance space "b" (FIG. 8) is created, thereby allowing heating element 28 to pass into notch 30*a*. Heating element 28 is then moved to its upper most position within notch 30*a*, as shown in FIG. 9, which allows the edges 34*a* to snap back into locking position relative to heating element 28. As shown in FIG. 10, the distance "c" between edges 34*a* is less than the outside diameter of heating element 28, thus preventing the latter from returning back through the throat 48.

From the foregoing, it is apparent that the improved heater element cutouts described above completely eliminate the need for various hardware items to mount the heater on the unit 10. In addition to material savings, assembly labor is also reduced since the heating element 28 is simply snapped into place. Since the heating element 28 directly contacts the fins 14, heat is conductively drawn from the heating element 28 by conduction to the fins 14. This direct heat transfer substantially increases the operating efficiency of the unit and also reduces the temperature at the surface of heating element 28. Since the surface temperature is substantially reduced, compared to prior art designs, less expensive materials of thinner wall dimension may be employed as a sheathing for the resistance wire defining heating element 28.

Additionally, the novel mounting provided by the cutout design of the present invention yields a heating cycle possessing minimum response time with a substantial increase in the volume of frost and ice which may be defrosted during the defrost cycle.

It is recognized, of course, that those skilled in the art may make various modifications or additions to the preferred embodiment chosen to ilustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

I claim:

1. A refrigeration unit of the type comprising a plurality of spaced, parallel, metal fins, at least one refrigerant tube extending through the fins and in mechanical engagement therewith, and a rod-like heating element for defrosting said unit, wherein the improvement comprises:

an entry slot in at least one of said fins extending inwardly from a peripheral edge thereof and through which said heating element may be introduced into said fin;

said entry slot being inwardly tapered to define a narrowed deformable throat at the inner end of said slot, said throat being defined by a pair of opposing edges of said cutout, said edges being spaced apart a distance marginally less that the outside cross sectional dimension of said heating element thereby to present resistance to the passage of said heating element through said throat; and a notch in said fin communicating with said throat and within which said heating element is normally held, said notch having a first dimension parallel to said entry slot which is substantially greater that the diameter of said heating element and a second dimension transverse to said entry slot which is substantially equal to the diameter of the heating element to allow said heating element to clear said throat upon insertion of said heating element into said notch but to be firmly held in said notch.

2. The cooling fin of claim 1, wherein said edges comprise essentially resilient material and are deformable away from each other upon passage of said heating element therethrough.

* * * * *